US005799698A

United States Patent [19]

Lin

[11] Patent Number: 5,799,698

[45] Date of Patent: Sep. 1, 1998

[54] SWITCH FOR GAS BURNER

[76] Inventor: Hsing-Chu Lin, 523, Pei Hsin Street, Chia-Yi City, Taiwan

[21] Appl. No.: 658,555

[22] Filed: Jun. 5, 1996

[51] Int. Cl.[6] ..... F16K 11/14

[52] U.S. Cl. ..... 137/628; 137/868; 431/280

[58] Field of Search ..... 137/628, 868; 431/280

[56] References Cited

U.S. PATENT DOCUMENTS 1,960,852 5/1934 Lundgoot ..... 431/280

*Primary Examiner*—Gerald A. Michalsky
*Attorney, Agent, or Firm*—Larson & Taylor

[57] ABSTRACT

A switch for a gas burner includes a shaft and a rod engaged with the shaft so as to be rotated by the shaft. A cylindrical member has two depressions formed in one end for engaging with the rod. A disc is secured to a housing and has a recess communicating with a slot. A barrel is rotatably engaged in the housing. A stem is engaged in the barrel and has a plug for enclosing the bore. The bore of the barrel is enclosed by the plug when the rod is engaged in the depressions of the cylindrical and is opened when the stem is moved by the rod and the ring.

1 Claim, 3 Drawing Sheets

SWITCH FOR GAS BURNER

BACKGROUND OF THE INVENTION

1. Field of the Invention

The present invention relates to a gas burner, and more particularly to a switch for controlling the ignition and the flame of the gas burner.

2. Description of the Prior Art

Typical gas burners are provided for family use in which the gas pressure of the supplying gas is very low. The switches of the typical gas burner for controlling the ignition and the flame is good for use in such gas burner of lower gas pressure only and may not be used for gas burner having a gas supply of larger gas pressure.

The present invention has arisen to provide a novel switch for gas burners.

SUMMARY OF THE INVENTION

The primary objective of the present invention is to provide a switch having a novel configuration.

In accordance with one aspect of the invention, there is provided a switch for a gas burner, the switch comprises a body including a puncture formed therein, a shaft rotatably engaged in the puncture of the body, the shaft including a slit formed therein, a rod engaged in the slit of the shaft so as to be rotated by the shaft, a cylindrical member secured in the housing and including a first end having two depressions formed therein for engaging with the rod and having a second end, a ring secured to the second end of the cylindrical member and including a bar formed therein, means for biasing the rod to engage with the cylindrical member, a housing including a first end secured to the body and including a second end, the housing including at least one orifice and an aperture formed therein, a disc secured to the second end of the housing, the disc including a slot having a first end of smaller size and having a second end of larger size, the disc including a side portion having a recess formed therein and facing away from the housing, the first end of the slot being communicating with the recess, a nozzle secured to the housing and including a hole for communicating with the recess and the slot, a barrel rotatably engaged in the housing for defining a gap between the barrel and the housing, the barrel including a first end having a pair of legs and a channel formed therein for engaging through the ring and the cylindrical member, the rod being engaged in the channel so as to allow the barrel to be rotated by the shaft, the barrel including a bore formed therein, the barrel including an outer peripheral portion having an annular groove formed therein for aligning with the aperture and including an approach communicating the annular groove with the bore, the barrel including a conduit for communicating the slot to the gap, the barrel including a pathway for communicating the orifice to the bore of the barrel, a stem slidably engaged in the bore of the barrel, the stem including a first end for engaging with the bar of the ring and including a second end having a plug for enclosing the bore, means for biasing the plug to enclose the bore, two sealing rings engaged on the barrel and arranged beside the annular groove, and means for biasing the ring to engage with the cylindrical member. The bore of the barrel is enclosed by the plug when the rod is engaged in the depressions of the cylindrical member, and the rod is disengaged from the depressions so as to move the cylindrical member and the ring and the stem and so as to disengage the plug from the bore when the rod is rotated by the shaft, and gas from the orifice is thus allowed to flow into the aperture and to flow into the hole of the nozzle when the plug is disengaged from the bore and when the conduit is aligned with the slot.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
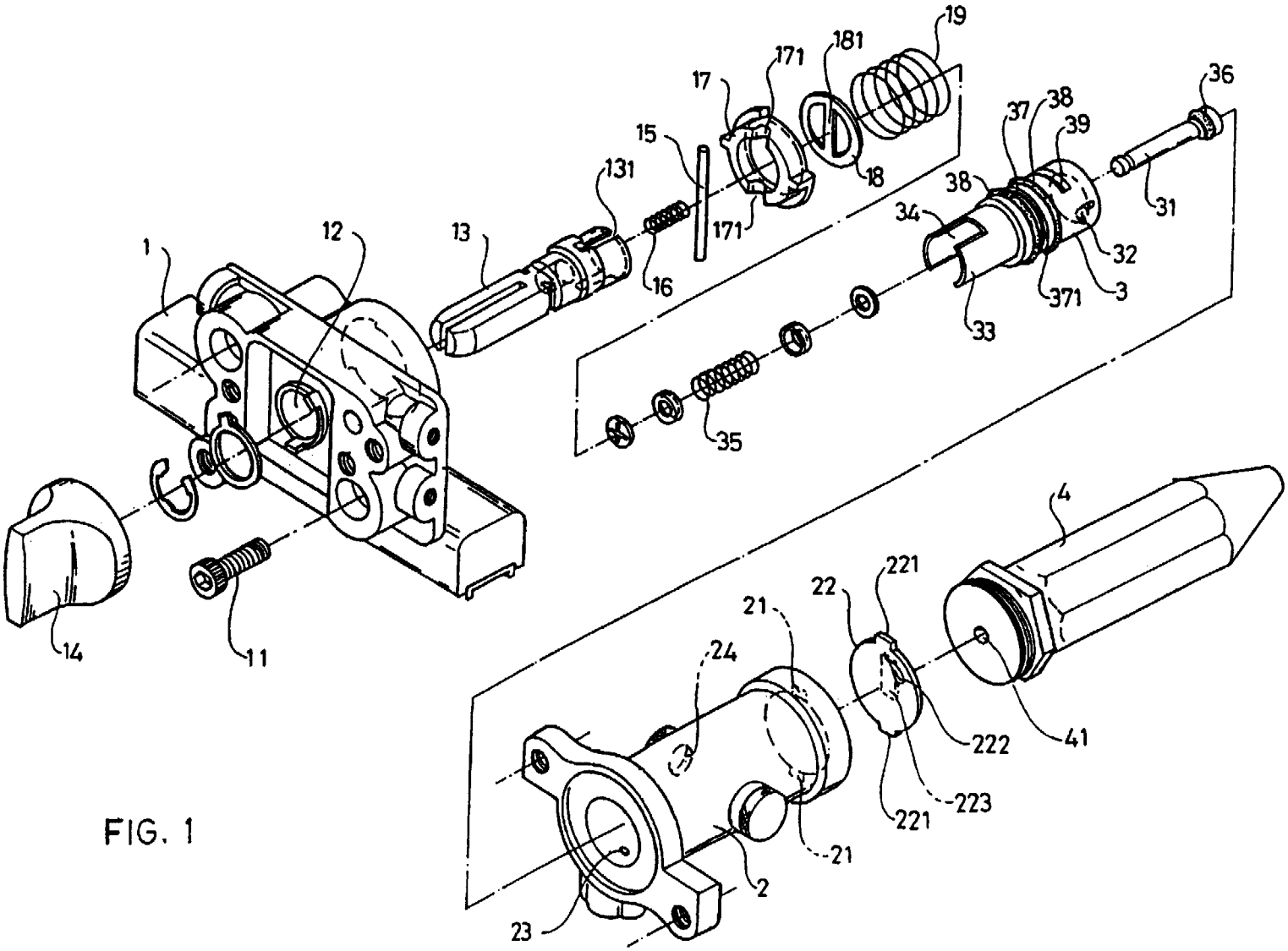
FIG. 1 is an exploded view of a switch in accordance with the present invention.
Figure 2:
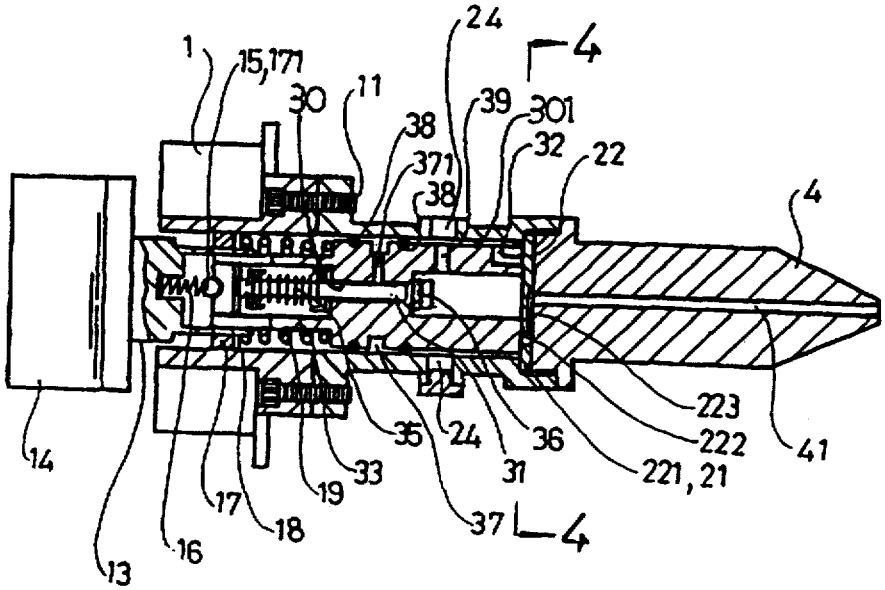
FIGS. 2 and 3 are cross sectional views of the switch, illustrating the operation of the switch.

Referring to the drawings, and initially to FIGS. 1 and 2, a switch for a gas burner in accordance with the present invention comprises a body 1 including a puncture 12 formed therein for rotatably engaging a shaft 13 therein. The shaft 13 includes a slit 131 formed therein for engaging with a rod 15. A cylindrical member 17 is secured in one end of the body 1 and includes two depressions 171 formed therein for engaging with the rod 15. A ring 18 is secured to one end of the cylindrical member 17 opposite to the depressions 171. The ring 18 includes a bar 181 formed therein. A spring 16 is engaged between the rod 15 and the shaft 13 for biasing the rod 15 to engage with the cylindrical member 17. A knob 14 is secured to the shaft 13 for rotating the shaft 13 and the rod 15.

A housing 2 includes one end secured to the body 1 by fastening screws 11 and includes two notches 21 formed in the other end for engaging with two projections 221 of a disc 22. The disc 22 includes a slot 222 having one end of smaller size than the other end and includes a recess 223 formed in one side facing away from the housing 2. The recess 223 communicates with the end of smaller size of the slot 222 (FIGS. 2 and 3) so as to form a gas flowing passage. The housing 2 includes one or more orifices 24 for coupling to a gas supplier and for receiving gas from the gas supplier. The housing 2 further includes an aperture 23 so as to supply gas to an outlet for forming a spare flame. A nozzle 4 is secured to the housing 2 and includes a hole 41 for communicating with the recess 223 and the slot 222.

Figure 3:
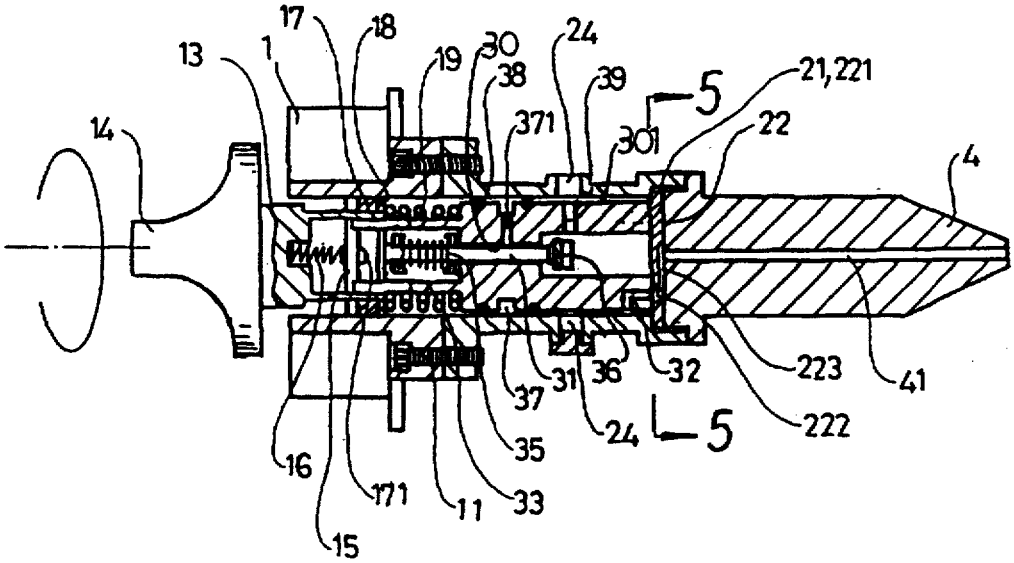
Figure 5:
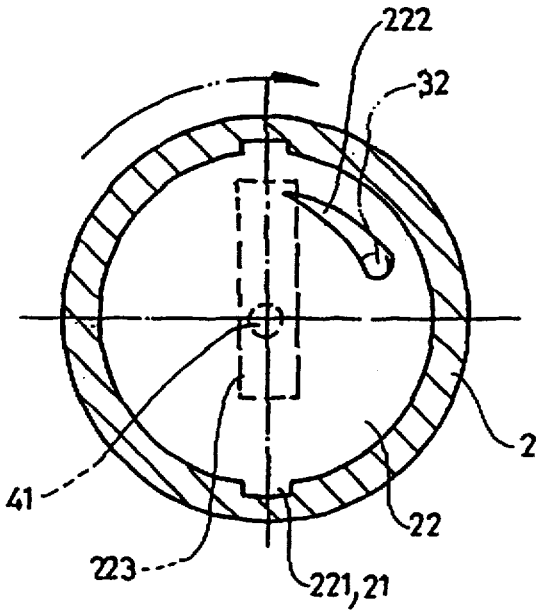

A barrel 3 is rotatably engaged in the housing 2 and includes a pair of legs 33 and a channel 34 formed in one end for engaging through the ring 18 and the cylindrical member 17. The rod 15 is engaged in the channel 34 such that the barrel 3 may be rotated by the shaft 13 and the knob 14 via the rod 15. A stem 31 is slidably engaged in the bore 30 of the barrel 3 and includes a plug 36 for enclosing the bore 30 (FIG. 2). A spring 35 is engaged on the stem 31 for biasing the plug 36 to enclose the bore 30. The stem 31 includes one end engaged with the bar 181 of the ring 18 such that the stem 31 may be moved by the ring 18. The barrel 3 includes an annular groove 37 formed in the outer peripheral portion of the middle portion thereof and aligned with the aperture 23, and includes an approach 371 communicating the annular groove 37 with the bore 30 (FIGS. 2 and 3). Two sealing rings 38 are engaged on the barrel 3 and arranged beside the annular groove 37. The barrel 3 includes a conduit 32 having one end for communicating with the slot 222 and having the other end for communicating with the gap 301 formed between the barrel 3 and the housing 2. The gas from the orifice 24 may flow through the gap 301 and the conduit 32 and the slot 222 and the recess 223 so as to flow into the hole 41 of the nozzle 4 when the conduit 32 is aligned with the slot 222 (FIGS. 3 and 5). The barrel 3 includes a pathway 39 for allowing the gas from the orifice 24 to flow into the barrel 3. A spring 19 is engaged between the barrel 3 and the ring 18 for biasing the ring 18 to engage with the cylindrical member 17.

Figure 4:
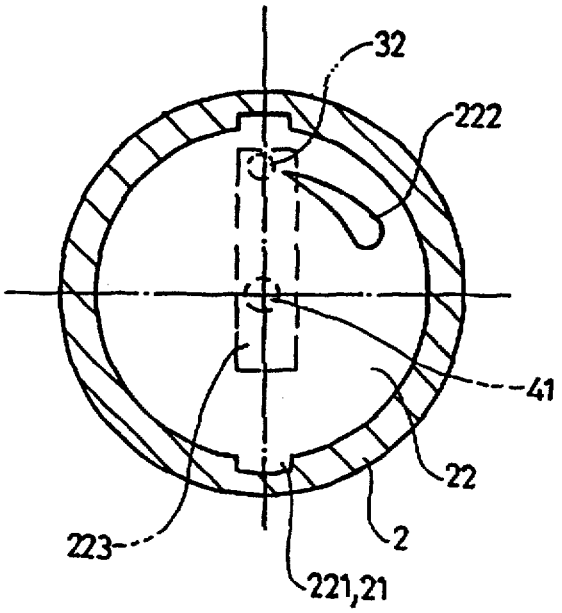
FIGS. 4 and 5 are cross sectional views taken along lines 4—4 and 5—5 respectively.

In operation, as shown in FIGS. 1 and 2, the rod 15 is engaged in the depressions 171 of the cylindrical member 17 such that the stem 31 has not been moved by the cylindrical member 17 and the ring 18 at this moment and such that the plug 36 may enclose the bore 30 of the barrel 3. In addition, the conduit 32 is disengaged from the slot 222, best shown in FIG. 4.

As shown in FIGS. 3 and 5, when the rod 15 and the shaft 13 are rotated by the knob 14, the rod 15 may be disengaged from the depressions 171 and may move the cylindrical member 17 and the ring 18 against the spring 19 so as to move the stem 31 such that the plug 36 is disengaged from the bore 30 and such that the bore 30 is opened. At this moment, the gas from the orifice 24 may flow into the bore 30 via the pathway 39 and may thus flow into the approach 371 and the annular groove 37 and may thus flow out of the aperture 23. The conduit 32 is aligned with the slot 222, best shown in FIG. 5, such that the gas from the orifice 24 may also flow through the gap 301 and the conduit 32 and the slot 222 and the recess 223 so as to flow into the hole 41 of the nozzle 4.

The switch in accordance with the present invention includes a novel configuration that has not been disclosed in the art.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A switch for a gas burner, said switch comprising:

a body including a puncture formed therein, a shaft rotatably engaged in said puncture of said body, said shaft including a slit formed therein, a rod engaged in said slit of said shaft so as to be rotated by said shaft, a cylindrical member secured in said housing and including a first end having two depressions formed therein for engaging with said rod and having a second end, a ring secured to said second end of said cylindrical member and including a bar formed therein, means for biasing said rod to engage with said cylindrical member, a housing including a first end secured to said body and including a second end, said housing including at least one orifice and an aperture formed therein, a disc secured to said second end of said housing, said disc including a slot having a first end of smaller size and having a second end of larger size, said disc including a side portion having a recess formed therein and facing away from said housing, said first end of said slot being communicating with said recess, a nozzle secured to said housing and including a hole for communicating with said recess and said slot, a barrel rotatably engaged in said housing for defining a gap between said barrel and said housing, said barrel including a first end having a pair of legs and a channel formed therein for engaging through said ring and said cylindrical member, said rod being engaged in said channel so as to allow said barrel to be rotated by said shaft, said barrel including a bore formed therein, said barrel including an outer peripheral portion having an annular groove formed therein for aligning with said aperture and including an approach communicating said annular groove with said bore, said barrel including a conduit for communicating said slot to said gap, said barrel including a pathway for communicating said orifice to said bore of said barrel, a stem slidably engaged in said bore of said barrel, said stem including a first end for engaging with said bar of said ring and including a second end having a plug for enclosing said bore, means for biasing said plug to enclose said bore, two sealing rings engaged on said barrel and arranged beside said annular groove, and means for biasing said ring to engage with said cylindrical member, said bore of said barrel being enclosed by said plug when said rod is engaged in said depressions of said cylindrical member, and said rod being disengaged from said depressions so as to move said cylindrical member and said ring and said stem and so as to disengage said plug from said bore when said rod is rotated by said shaft, and gas from said orifice being allowed to flow into said aperture and to flow into said hole of said nozzle when said plug is disengaged from said bore and when said conduit is aligned with said slot.

* * * * *